United States Patent [19]

Sundahl

[11] Patent Number: 4,807,305

[45] Date of Patent: Feb. 28, 1989

[54] HELMET SHIELD MECHANISM

[75] Inventor: James G. Sundahl, Irvine, Calif.

[73] Assignee: Bell Helmets Inc., Norwalk, Calif.

[21] Appl. No.: 930,577

[22] Filed: Nov. 14, 1986

[51] Int. Cl.[4] ..... A42B 3/02

[52] U.S. Cl. ..... 2/424; 2/436

[58] Field of Search ..... 2/6, 7, 8, 9, 2.1 A, 2/424, 427, 436, 411

[56] References Cited

U.S. PATENT DOCUMENTS

| | | | |
|---|---|---|---|
| 2,954,564 | 10/1960 | Sowle | 2/9 |
| 3,430,263 | 3/1969 | Newcomb | 2/8 |
| 3,593,338 | 7/1971 | Penny | 2/427 |
| 3,696,442 | 10/1972 | Amundsen et al. | 2/8 |
| 3,748,657 | 7/1973 | Aileo | 2/6 |
| 3,943,574 | 3/1976 | Yamaguchi et al. | 2/9 |
| 4,292,688 | 10/1981 | Ellis | 2/6 |
| 4,297,747 | 11/1981 | Nava | 2/424 |
| 4,581,775 | 4/1986 | Nava | 2/424 |
| 4,615,052 | 10/1986 | Nava | 2/424 |

FOREIGN PATENT DOCUMENTS

| | | | |
|---|---|---|---|
| 1560723 | 2/1980 | United Kingdom | 2/424 |

*Primary Examiner*—Wm. Carter Reynolds

*Attorney, Agent, or Firm*—William W. Haeflinger

[57] ABSTRACT

A helmet has an outer shell with a front viewing opening, and a visor swingable between up and down positions. The helmet also includes structure mounting the visor to swing between such positions, and detent structure on one arm portion of a ratchet plate to retain the visor in such positions. The detent structure includes shoulders to lock the visor in at least one of such positions, and to allow easy unlocking by manual deflection of a portion of the visor, away from the shell. The ratchet plate also has a second arm portion attached to an inwardly recessed section of the shell, so that the visor is swingable in closely spaced relation to the shell outer front surface.

4 Claims, 5 Drawing Sheets

FIG. 2.
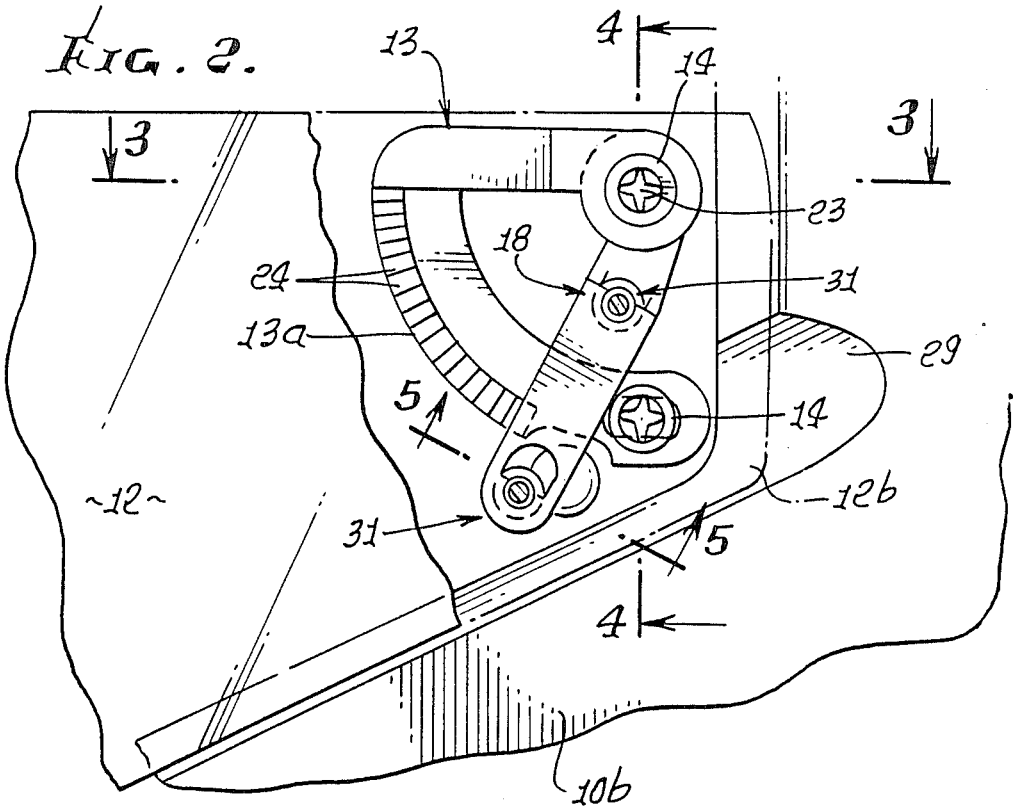
FIG. 3.
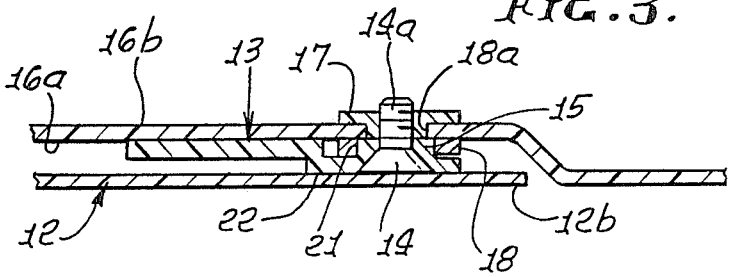
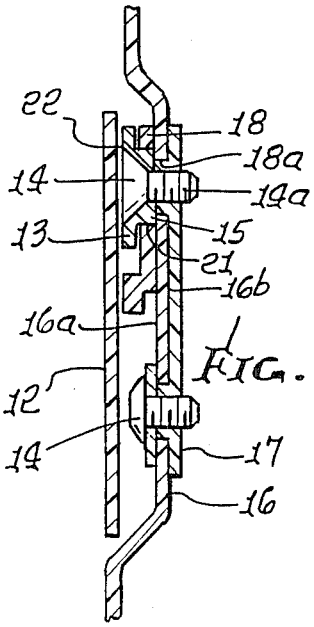
FIG. 4.
FIG. 5.
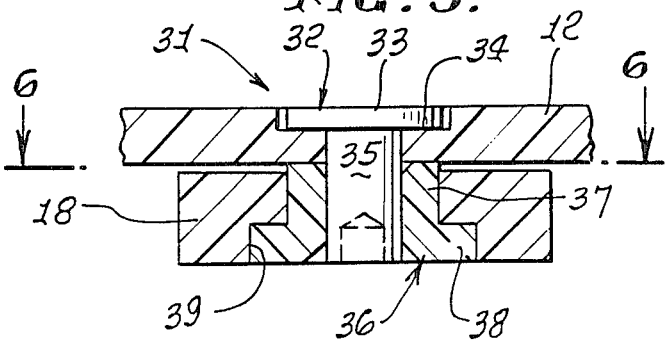

FIG. 15.
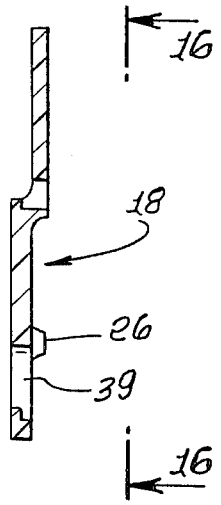
FIG. 16.
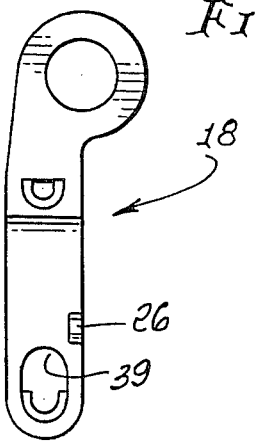
FIG. 19.
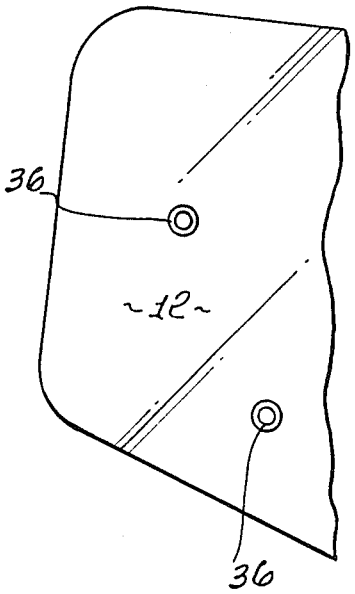
FIG. 17.
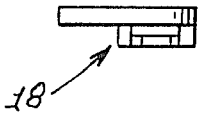
FIG. 18.
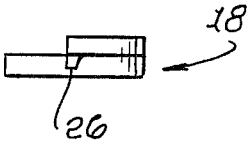
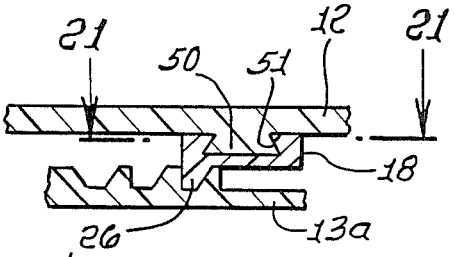
FIG. 20.
FIG. 21.
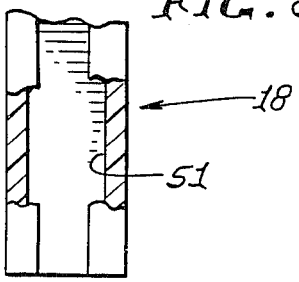

HELMET SHIELD MECHANISM

BACKGROUND OF THE INVENTION

This invention relates generally to adjustment of wind shields or visors associated with helmets; more particularly it concerns method and means to accomodate pivoting of a shield between multiple positions and automatic retention of the shield at each of such positions, and allowing for ease of manual pivoting.

Adjustment shifting of transparent wind shields is commonly employed on helmets to allow the user to move the shield into and out of position in front of his eyes. In the past, such shifting presented certain problems, including rubbing and scuffing of the helmet and shield leading to their deterioration; the need for complex adjustment mechanism which then could malfunction in use; and inadequate retention of the shield in selected positions. There is a need for simple, effective shield adjustment means which will automatically hold the shield in selected positions after simple pivoting of the shield to those positions, without scuffing the helmet. There is also need for easily manually manipulated means to accomplish such pivoting or shifting of the shield or visor, and between multiple position between fully raised and lowered positions; and means to lock the shield in lowered position.

SUMMARY OF THE INVENTION

It is a major object of the invention to provide means to meet the above need. Fundamentally, such means comprises:

(a) means mounting the visor to swing between said positions, (b) and detent means to retain the visor in said positions, said detent means including means to lock the visor in at least one of said positions, and to allow unlocking by manual deflection of a portion of the visor, away from the shell.

More specifically, the detent means are typically located at opposite sides of the helmet; the lock means is located at one side of the helmet; and the detent means may typically include a series of detent shoulders arranged in an arc at one outer side of the helmet, and said lock means includes a lock shoulder located in an extension of said arc.

Further, the means mounting the visor to swing may typically include visor bearings located at left and right sides of the shell and defining an axis about which said arc extends; and the detent means may advantageously include two arc-shaped arms attached to the shell at opposite sides of the helmet, the lock means including a first lock shoulder on said arm at the left side of the helmet; and the means mounting the visor to swing defines an axis about which the arms extend. In this regard, the visor then carries a second lock shoulder engagable with the first lock shoulder on the arm at the left side of the helmet, the second shoulder liftable to ride over the first shoulder to allow swinging of the visor from closed to open position.

These and other objects and advantages of the invention, as well as the details of an illustrative embodiment, will be more fully understood from the following specification and drawings, in which:

DRAWING DESCRIPTION

FIG. 2 is an enlarged, fragmentary side elevation, partly broken away, to show interior structure, in visor down position;

FIG. 3 is a sectional plan view on lines 3—3 of FIG. 2;

FIG. 4 is an enlarged end elevation, in section, taken on lines 4—4 of FIG. 2;

FIG. 5 is an enlarged fragmentary section, on lines 5—5 of FIG. 2;

Figure 10A:
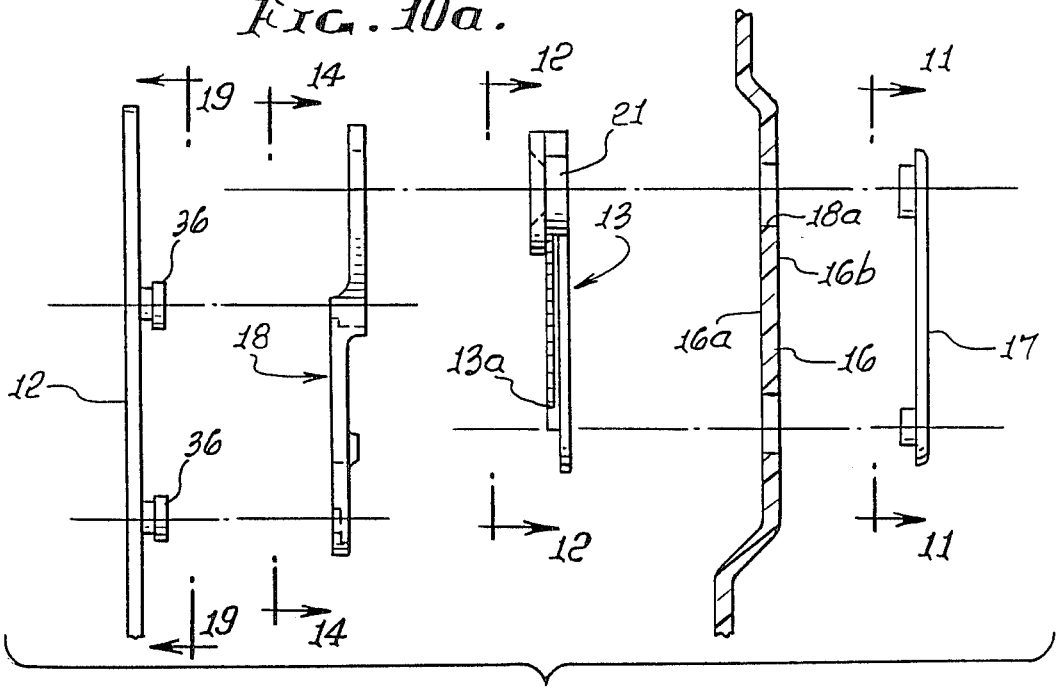
Figure 11:
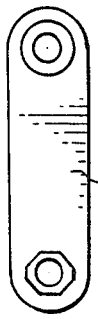
Figure 12:
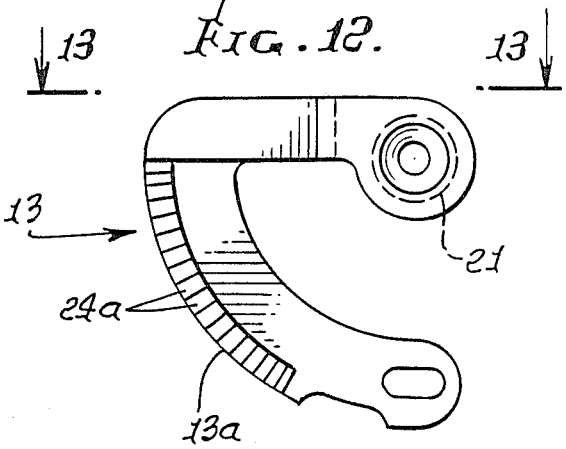
Figure 14:
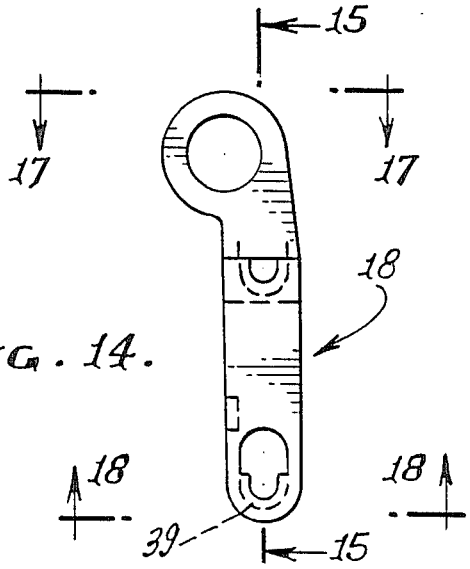

FIG. 10*a* is an exploded view of detent, ratchet, swing arm, helmet shell and visor structure;

FIGS. 11, 12 and 14 are elevations on lines 11—11,-12—12 and 14—14, respectively, of FIG. 10*a;*

Figure 13:
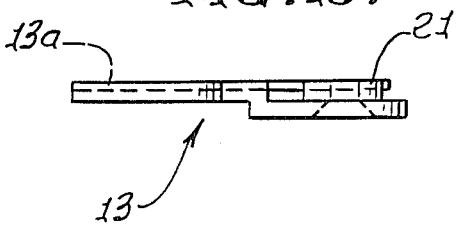

FIG. 13 is a view on lines 13—13 of FIG. . 13;

FIG. 15 is a section on lines 15—15 of FIG. 14;

FIG. 16 is a side view on lines 16—16 of FIG. 15;

FIG. 17 is a view on lines 17—17 of FIG. 14;

FIG. 18 is a view taken on lines 18—18 of FIG. 14;

FIG. 19 is a fragmentary side view on lines 19—19 of FIG. 10*a*

Figure 9:
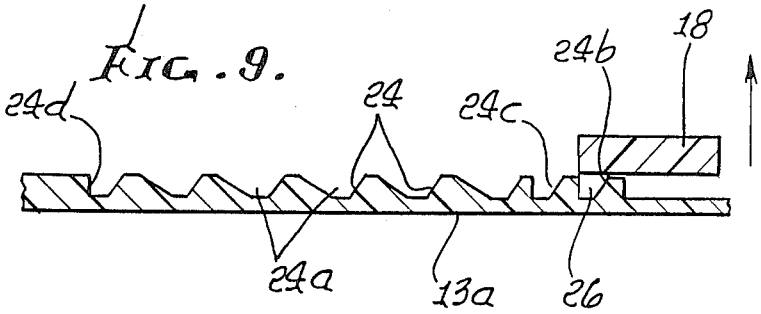
FIG. 9 is an enlarged sectional view on lines 9—9 of FIG. 8, and showing ratchet structure at the left side of the helmet.
Figure 10:
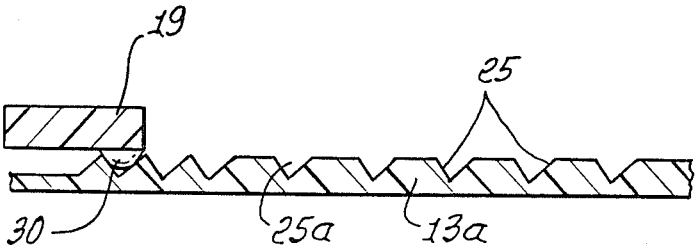
FIG. 10 is a view like FIG. 9, but showing ratchet structure at the right side of the helmet.
Figure 6:
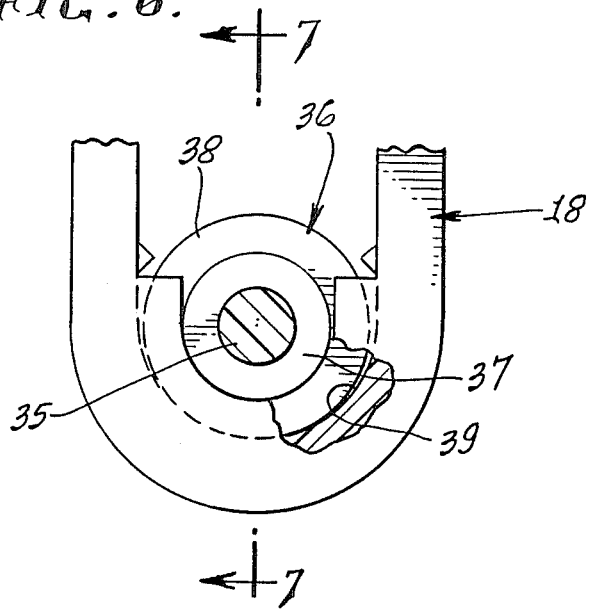
FIG. 6 is a section taken on lines 6—6 of FIG. 5.
Figure 7:
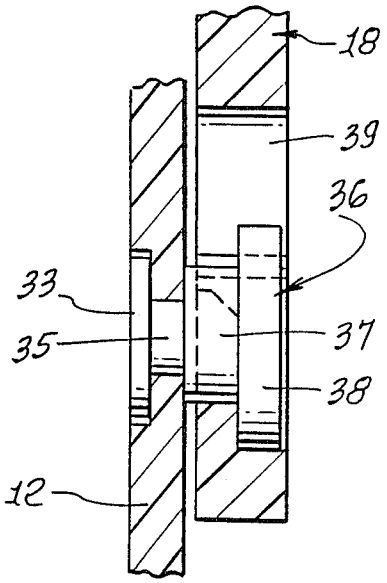
FIG. 7 is a section on lines 7—7 of FIG. 6.

FIG. 20 is a view like FIG. 9, showing a modification;

FIG. 21 is a section on lines 21—21 of FIG. 20.

DETAILED DESCRIPTION

Figure 1:
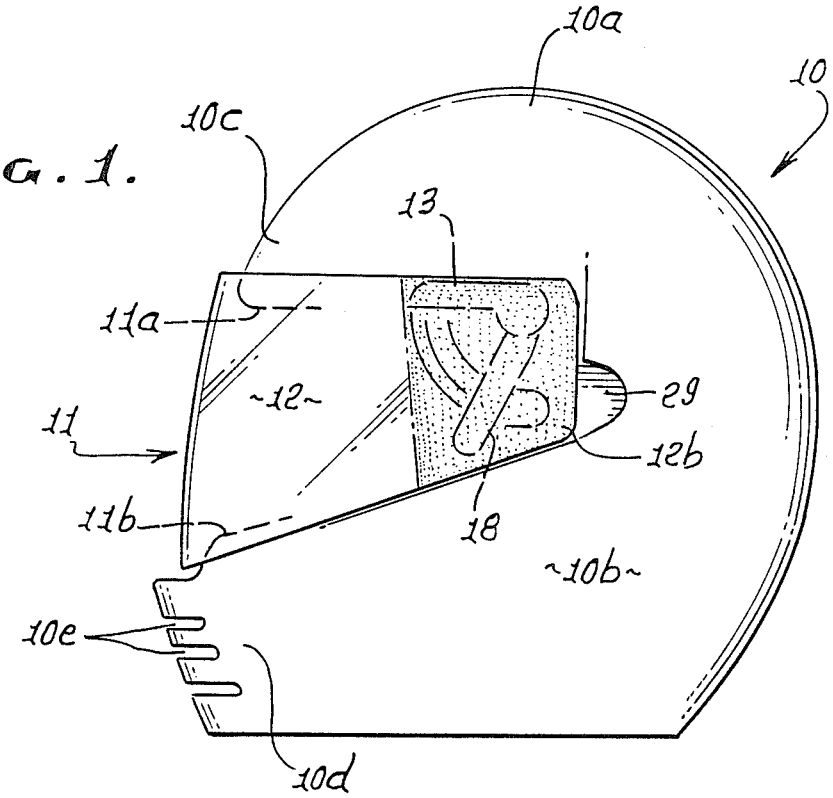
FIG. 1 is a side elevation showing a helmet incorporating the invention.

In FIG. 1, a helmet 10, as for example is used by a motorcyclist, has a top 10*a*, opposite sides 10*b*, and upper front 10*c*. The latter is cut-away at 11 in front of the wearer's face. Upper and lower boundaries of the cut-out appear at 11*a* and 11*b*. Lower portion 10*d* of the helmet juts forwardly, and may form ventilation inlets 10*e* for air to sweep up past the inner surface of a shield or visor 12.

Figure 8:
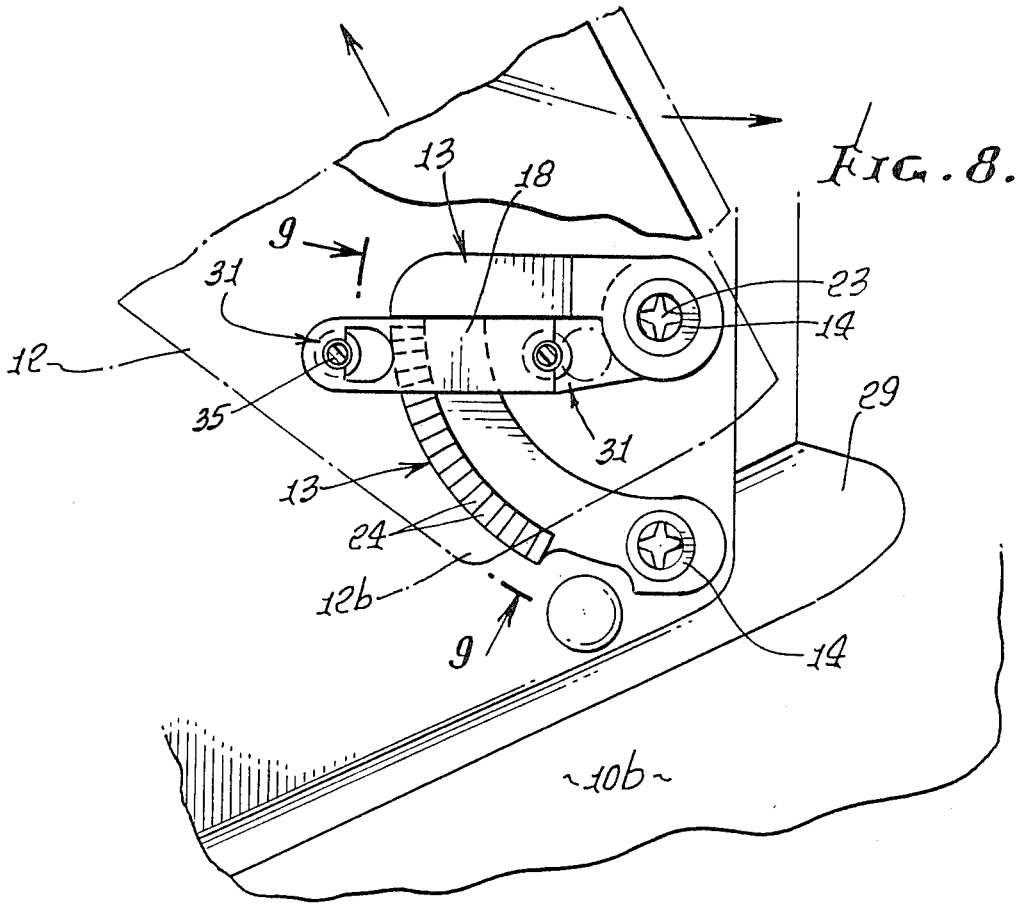
FIG. 8 is a view like FIG. 2, showing structure positioning a visor in up-position.

Shield 12 is in the form of a unitary, thin plastic, transparent sheet curved to extend about the helmet from its front to regions close to but spaced from opposite sides of the helmet. Means is provided to mount the shield to the helmet for selective pivoting between multiple positions, as for example the fully lowered position of FIGS. 1 and 2 in which the wearer's face is completely protected; the fully raised position of FIG. 8 in which the wearer's face is substantially fully)exposed, frontwardly through the cut-away 11; and intermediate partly raised positions as correspond to positions of ratchet detents to be described. Such means may advantageously take the form of a bearing or ratchet plate 13 attached by a fastener 14 to the helmet side; and typically two pairs of such plates and fasteners are provided, one at each outer side of the helmet. Each bearing plate may consist of a thin plastic plate having an integral boss 15 or lug which fits against the outer side 16*a* of the helmet shell, side 16*a* being recessed inwardly, as shown. As seen in FIG. 3, the fastener includes a threaded portion 14*a* in threaded engagement with- a nut plate 17 at the side 16*b* of shell 16. Nut plate 17 projects into and fits a drilled hole 18*a* in the shell. The shield is mounted to two swing arms 18 and 19 which are in turn pivotally mounted at 20 to bearings 21 formed by the ratchet plate, whereby the shield has sliding, face to face bearing engagement at 22 with the plate 13, and that bearing plate 13 acts as a pivot or bearing for the shield, as well as for the swing arm 18. The structure shown in FIG. 3 at the left side of the helmet is also provided at the right side of the helmet. Such bearings then define a lateral axis 23 about which arms 18 swing.

The bearing or ratchet plate at each side of the helmet includes detent means serving to retain the visor or shield in the previously described up and down positions, and also in other intermediate positions. In the example of FIGS. 2, 8, 9 and 10, the detent means associated with each plate 13 includes a series of detent shoulders on an arc-shaped arm 13*a*. Such shoulders at the left side of the helmet are designated at 24, and those at the right side of the helmet at 25. The shoulders are located at the sides of associated detent notches 24*a* and 25*a*. The swing arm 18 attached to the visor at the left side of the helmet incorporates an integral pawl or lug 26 receivable in the successive notches 24*a* as the arm and visor are swung about axis 23. Arm 13*a* curves circularly about axis 23, as do the successive notches 24*a*. Note that all the notches except end notches 24*b*, 24*c*, and 24*d* have ramp shaped sides, allowing the trapezoidal cross section pawl 26 to ride up and over those sides as the visor or swing arm are pivoted. End notches 24*b*, 24*c* and 24*d* have cross sections closely matching that of the pawl, so as to lock the pawl in the notch, thereby providing lock means. In this regard, the pawl is yieldably or resiliently urged toward and into the notches by the visor sheet part to which the swing arm is attached, the connection, as seen in Fig . 3 providing the bending stiffness required to urge the pawl into the notches, as described. Unlocking is accomodated by "lifting" the visor edge portion. 12*b* outwardly away from the shell, and the recessed zone 29 in the shell provides finger insertion space to allow outward resilient "prying" of the edge portion 12*b* to afford such "lifting" with consequent unlocking, after which the visor may be lifted. Notch 24*c* is similar to notch 24*b*, and allows locking of the visor in "anti-fogging" position, with pawl 26 in that notch. (Ventilation air then may pass below the lower lip of the visor to gain access to the inner side of the visor to defog same). Upper end notch 24*d* is similarly shaped to lock the visor in up position, and its tapered side allows "ramping" of the pawl in a visor closing direction, when sufficient closing force is applied to the visor.

The detent notches 25 at the right side of the visor and helmet are shown as saw-tooth in shape to partly receive a convex surfaced pawl 30 on associated arm 19. Such configuration allows relative ease of visor pivoting, without locking in any position, while at the same time stabilizing the right side of the visor in selected position, therefore, it is the left side of the visor which fundamentally controls visor position, including lock positions, and this allows the motorcyclist's use of his left hand to control his visor position, while his right hand remains in control of the motorcycle throttle.

FIG. 5 illustrates in detail one of the connections of the visor 12 to the swing arm 18, such connections also indicated at 31 in FIG. 2. A fastener 32 has a head 33 received in a recess 34 in the visor, nd a shank 35 projects into an opening in the swing arm. A button 36 has a tubular shank, and a head 38 received in socket 39 in the arm 18.

FIG. 10*a* shows in exploded form the interrelationship of the five elements that also appear interconnected in FIGS. 3 and 4, and FIGS. 11–19 further show element details. FIG. 12 shows the generally U-shaped structure of the ratchet plate 13.

In the modification seen in FIGS. 20 and 21 the elements that remain the same bear the same numerals; however, the connection of the shield or visor 12 to the swing arm 18 is via the dove-tail tongue 50 and dove-tail recess 15, is shown.

I claim:

1. In a helmet having an outer shell with a front viewing opening, and a visor swingable between up and down positions, the combination comprising:

(a) means mounting the visor to swing between said positions, (b) and detent means to retain the visor in said positions, said detent means including means to lock the visor in at least one of said positions, and to allow unlocking by manual deflection of a portion of the visor, away from the shell, (c) said detent means including at least one arc shaped sequence of detent notches, and including swing arm means attached to the visor and carrying a detent tongue means successively receivable in said notches as the visor is pivoted, the stiffness of the visor resiliently urging the tongue means toward and into certain notches as the visor is pivoted, (d) said means mounting the visor to swing including visor bearing means on the shell, the swing arm means pivotally supported by said bearing means, said bearing means including two bearings respectively at opposite sides of the helmet, said swing arm means including two swing arms respectively at opposite sides of the helmet and each attached to the visor at said opposite sides of the helmet, (e) and wherein there are dove-tail tongue and recess elements rigidly attaching the swing arms to the visor, and at two locations at each side of the helmet.

2. The combination of claim 1 wherein the visor remains closely adjacent to the shell in all visor positions relative to the shell.

3. The combination of claim 1 wherein said visor has a liftable rear edge portion rearward of said swing arm means, the shell having a recessed zone adjacent said visor rear edge portion, allowing finger reception beneath said rear edge portion.

4. The combination of claim 1 wherein said dovetail tongue and recess elements are rigidly attaching the swing arms to the visor, and at said two locations at each side of the helmet.

* * * * *